US011534012B2

(12) United States Patent
Ederheimer

(10) Patent No.: US 11,534,012 B2
(45) Date of Patent: Dec. 27, 2022

(54) CONTAINER AND APPARATUS FOR ASSISTING THE SCOOPING OF COMPOSITIONS

(71) Applicant: Justin Ederheimer, Gambrills, MD (US)

(72) Inventor: Justin Ederheimer, Gambrills, MD (US)

( * ) Notice: Subject to any disclaimer, the term of this patent is extended or adjusted under 35 U.S.C. 154(b) by 85 days.

(21) Appl. No.: 16/729,734

(22) Filed: Dec. 30, 2019

(65) Prior Publication Data

US 2021/0196061 A1 Jul. 1, 2021

(51) Int. Cl.
*A47G 19/00* (2006.01)
*A47G 19/02* (2006.01)

(52) U.S. Cl.
CPC ..... *A47G 19/02* (2013.01)

(58) Field of Classification Search
CPC .... A47G 19/02; A47G 19/06; A47G 2400/06; A47G 2400/067
USPC .... 220/628, 660, 719, 574.1, 600, 621, 574, 220/669, 731
See application file for complete search history.

(56) References Cited

U.S. PATENT DOCUMENTS

RE24,575 E * 12/1958 Constanzo ..... A47G 19/02 220/574
2009/0108004 A1* 4/2009 Bollengier ..... B65D 43/0202 220/574

FOREIGN PATENT DOCUMENTS

GB 2528903 * 2/2010 ..... A47G 19/02

* cited by examiner

*Primary Examiner* — John K Fristoe, Jr.
*Assistant Examiner* — Elizabeth J Volz
(74) *Attorney, Agent, or Firm* — Locke Lord LLP; Nicholas J. DiCeglie, Jr.

(57) ABSTRACT

Disclosed herein is a novel container/guacabowl and apparatus system that assists in the removal and apportionment of the semi-solid items, such as guacamole, salsa, dip and humus, from the interior of a bowl or container using an external object such as a tortilla chip or cracker, while minimizing the risk of spilling the semi-solid items as they are being removed.

18 Claims, 3 Drawing Sheets

CONTAINER AND APPARATUS FOR ASSISTING THE SCOOPING OF COMPOSITIONS

FIELD OF INVENTION

The present invention relates to a novel container, system and apparatus that assists in the removal and apportionment of the semi-solid items, such as guacamole, salsa, dip and humus, from the interior of a container or bowl using an external object such as a tortilla chip or cracker, while minimizing the risk of spilling the semi-solid items as they are being removed.

BACKGROUND

Guacamole, salsa, dip, and other edible substances are often provided in bowls, plates or other serving mediums. Individuals consume the edible substances using chips, bread, crackers, or other objects. Unfortunately for many individuals who prefer to consume ample amounts of substances (hereafter just referred to as guacamole for simplicity) per chip, it is often difficult to successfully scoop adequate or apportioned amount of guacamole onto the chip without having portions of the guacamole fall off the edges of the chip when it is removed from the bowl. Unsuccessful attempts often force individuals to resort to unsanitary methods such as using their fingers or inconvenient methods that require the use of secondary objects like spoons or other objects in order to push the salsa onto a tortilla chip.

In order to solve these problems, the present inventors have discovered a novel container, system and apparatus that provides for the convenient and orderly withdrawal of contents. In one example, the apparatus may serve edible substances and assist individuals to scoop ample amounts of edible substances onto objects. In addition, the novel system and apparatus, which facilitates the convenient and orderly withdrawal of contents, can be added to serving dishes, bowls/containers and the like.

The foregoing examples are intended to be illustrative and not exclusive. Other limitations of the novel container, system and apparatus will become apparent to those of skill in the art upon a reading of the specification and a study of the drawings.

SUMMARY OF THE INVENTION

The following embodiments and aspects thereof are meant to be exemplary and illustrative, not limiting in scope. In various embodiments, one, or more of the above described problems have been reduced or eliminated, while other embodiments are directed to other improvements.

A convenient system for apportioning and withdrawing contents from a container involves an enhancement provided to the container. An example of a container according to the system includes an enhanced container system that provides the functionality to apportion edible or inedible substances onto objects. In various examples, the enhancement may be found as an extension of the side of a bowl, the edge of a plate and dish, or other serving medium.

According to an embodiment, a container is disclosed comprising a base area having an interior base surface and an exterior base surface, a wall extending from the interior base surface, the wall having a concave interior wall surface extending from interior base surface and a exterior wall surface extending from the exterior base surface, a projection having a projection concave interior wall surface and a projection exterior wall surface that extends a portion of the wall beyond where the concave interior wall surface and the exterior wall surface combine to provide a substantially horizontal rim of the container, as the projection extends away from the base area of the container the projection concave interior wall surface arcs towards the base area and the center of the container to provide an arc of at least 70 degrees from the substantially flat base area, wherein the width of the projection tapers from an initial width at a point where the projection extends the portion of the container wall and the substantially horizontal rim arcs to a width that provides an apex having at least two projectiles pointing towards the base area, a channel that may have channel ridges that extend from a point on the base area and along the concave interior wall surface and the projection concave interior wall surface to the projectiles.

According to an embodiment, an apportionment apparatus is disclosed comprising a planar base having a planar base top surface and planar base bottom surface, a wall having a concave interior wall surface that extends from an end of the planar base top surface and an exterior wall surface that extends from the end of the planar base bottom surface, the concave interior wall surface extends away from the planar base and arcs towards the planar base to provide an arc of at least about 70 degrees from the planar base, the width of the concave wall tapers from an initial width at the planar base to a width that provides an apex having at least two projectiles pointing towards the planar base, a channel that may have channel ridges that extends from an end of the planar base that is distal to the concave interior wall surface and along the planar base and the concave interior wall surface to the projectiles, and a fastener that is integral with the planar base bottom surface and/or the exterior wall surface.

Advantageously, the proposed container apportionment systems provide for an orderly withdrawal and allotment of edible or inedible contents. For example, a container system that contains food may have the claimed system which allows a user to obtain an apportioned and/or specific quantity of food from the container in a precise manner. These and other advantages of the present invention will become apparent to those skilled in the art upon a reading of the following descriptions and a study of the several figures of the drawings.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments of the invention.

Figure 1:
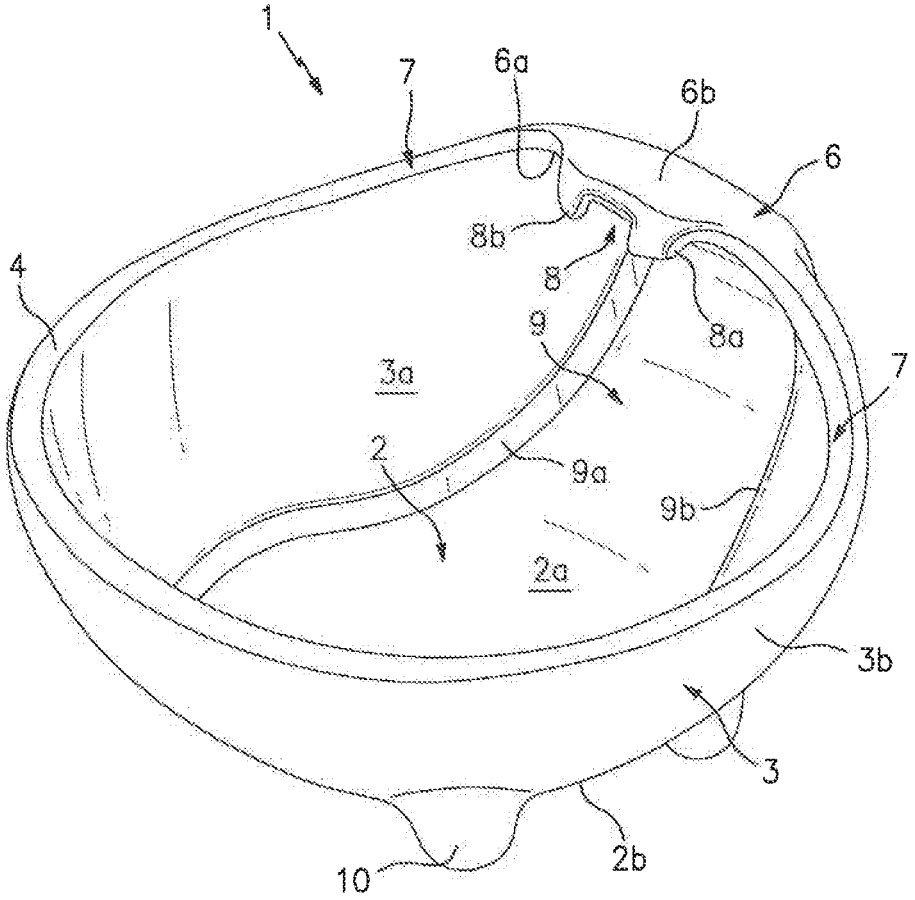
FIG. 1 presents a perspective aerial view of the interior of the claimed container system.

FIG. 1 depicts the serving apparatus/container (1) and its interior from a perspective aerial view. The container (1) of FIG. 1 includes a base area (2) having interior base surface (2*a*) and an exterior base surface, as well as a concave interior wall surface (3*a*) and an exterior wall surface (3*b*) to provide a wall (3). The wall (3) provides for the exterior of the container (1) and integrates with the exterior base surface (2*b*) of the base area (2). The container (1) has a rim (4), a projection (6) having a projection concave interior wall surface (6*a*) and a projection exterior wall surface (6*b*). The projection (6) includes an apex (8) having projectiles (8*a*, 8*b*). FIG. 1 also presents channel (9) comprising channel ridges (9*a*, 9*b*) that extend to the projectiles (8*a*, 8*b*) of the apex (8), as well as along a portion of the container's (1) interior wall surface (3*b*) and base area (2).

Container (1) may be any serving device, for example, a bowl, a guacabowl or other known and/or convenient device for serving or preparing edible substances. The container (1) may be formed of or include organic polymers, polyethylene, polypropylene, titanium dioxide, mineral filler, polypropylene, ceramic, glass, tin, aluminum, steel, cast-iron, wood, or any known and/or convenient material for serving or preparing edible substances. The container (1) may be cast, injection molded, carved, blown, or created through any known and/or convenient manner. The container (1) may be round, oval, square, rectangular, or any shape known and/or convenient.

The container (1) is not limited in size. For example, the container (1) can be a round or oval bowl that is 6 to 18 inches high, or shorter than 6 inches, or higher than 18 inches. The bowl can have a diameter at the rim of about 6 or less inches to 24 or more inches. The base area (2) of the container (1) is not limited in size and accommodates as needed the size of the container (1). The exterior base surface (2*b*) may comprise legs (10), or the like, however the base area (2) can be substantially horizontal with the wall (3) or side extending vertically or at an angle, i.e., concave, from the substantially horizontal base area (2). The base area (2) can be concave if needed to conform with the wall (3). The wall (3) or side extends from the base area (2) at any suitable angle such that the angle forms an arc from the base area (2) to the apex (8) of the projection (6) that is at least about 70 degrees (or 90, or 110, or 130 degrees, or more) relative to the substantially horizontal base (2). In some embodiments, the wall (3) or side does not extend from the base area (2) at a sharply defined angle, but instead with a gradual and/or curved transition from the base area (2). The wall (3) including the interior and exterior wall surfaces (3*a*, 3*b*) may be smooth, serrated, ribbed, or textured as desired. Additionally, the surface of the base area (2) and interior base surface (2*a*) may be smooth, serrated, ribbed, or textured as desired.

The channel (9) is not particularly limited in length, width, or height. The present invention contemplates that there may be more than one channel (9). The channel (9) is defined by ridges (9*a*, 9*b*) that can be about 1 to about 3 mm or more in height. However, the ridges (9*a*, 9*b*) may be subtle in appearance, for example, they may not have any height and may only define the interior surfaces from the channel (9). The channel (9) can be a grove or indent in the base area (2)/interior base surface (2*a*), as well as a grove or indent in the concave interior wall surface (3*a*) of wall (3). The channel (9) extends along the projection concave interior wall surface (6*a*) extending to the projectiles (8*a*, 8*b*) of the apex (8). The channel (9) originates in approximately the middle of the container's (1) base area (2), however, the channel (9) can extend the length of the entire base area (2), if desired. The ridges (9*a*, 9*b*) of the channel (9) extend across the base area (2), across the concave interior wall surface (3*a*) of wall (3), and across the projection concave interior wall surface (6*a*) to the projectiles (8*a*, 8*b*) of the apex (8). The surface of the channel (9) between the ridges (9*a*, 9*b*) is usually smooth, however, the surface may serrated, ribbed, or textured as desired.

The width channel (9) is not particularly limited and may be, for example 1-5 centimeters. Additionally, the channel may narrow or widen as it approaches the projectiles (8*a*, 8*b*) of the apex (8).

The channel (9) assists when one uses, for example, a chip to remove the edible substance that has been placed in the interior of the container (1). In order to facilitate the convenient and orderly withdrawal of contents from the container (1), a user would drag the contents to the projection (6) side of the container (1) until it reached the channel (9). As the container's (1) content is moved up through the channel (9) and onto the concave interior wall surface (3*a*) and then to the arc of projection concave interior wall surface (6*a*) passing the projectiles (8*a*, 8*b*) of the tapered apex (8) an apportioned quantity of contents is removed from the container (1). In addition to receiving the appropriate quantity of contents on to the chip, any excess content is prevented from escaping the container (1). The size of the projection (6) of the container (1) is not particularly limited, however, the projection (6) which comprises a tapering projection concave interior wall surface (6*a*) and a projection exterior wall surface (6*b*) that may or may not be convex and may or may not taper, delineates the portion of the container wall (7) that extends beyond the substantially horizontal portion of the container's (1) rim (4). The rim (4) is the area where the interior and exterior wall surface meet to provide the substantially horizontal surface, which can be flat, curved, or any desired shape, e.g., crenulations. At the delineation area, i.e., the point where the container wall (7) extends beyond the substantially horizontal rim (4) of the container (1), the rim (4) arcs to the contour of the projection (6), and the projection's (6) width at that point is not limited and may be, for example, ⅕, ¼, or ⅓ of the circumference of the container (1). In particular, it should be noted that the projection concave interior wall surface (6*a*) begins to taper as it extends away from the base area (2) of the container (1). The projection's (6) width may taper, for example, from a width of 6 or 8 inches at the portion of the container wall (7) to about 1 or 2 inches at the apex (8). The projection concave interior wall surface (6*a*) and a projection exterior wall surface (6*b*) are usually smooth, however, the surfaces may be textured as desired.

The apex (8) of the container (1) defines the end of the projection (6) where the contents of the container (1) are removed. The apex (8) contains at least two projectiles (8*a*, 8*b*) that define the end of the channel ridges (9*a*, 9*b*) and apex (8). The projectiles (8*a*, 8*b*) size and shape are not particularly limited and may be, for example, spherical or round in nature having a diameter of a few millimeters or more. Since the apex (8) protrudes into and over the container's (1) interior, any spillage of the contents remains within the interior of the container (1).

As the contents of the container (1) are reduced more of the channel (9) is exposed and available for a user to facilitate apportionment of the contents upon removal. For example, if a user is withdrawing guacamole using a tortilla chip, the guacamole can be easily and conveniently apportioned to the desired amount of guacamole onto the chip. Further, the claimed container system prevents spillage of the guacamole from the container (1), thereby facilitating the convenient and orderly withdrawal of the contents. In another example, a spoon may be used to withdraw the edible substance and the claimed container system and the user would apportion the edible substance without excess edible spilling outside of the container (1).

The thickness of the container (1) is not limited, and the wall (3) may have a greater degree of curvature on the concave interior wall surface (3*a*) than the convex exterior wall surface (3*b*). According to an embodiment, the concave interior wall surface (3*a*) has a degree of curvature as needed and the convex exterior wall surface (3*b*) is essentially straight (i.e., without curvature).

The edible content may be any food, including, but not limited to guacamole, salsa, and dip. In other embodiments, the edible content may be any fluid of elevated viscosity, including but not limited to honey, oils, syrups, and sauces.

The container (1) can be fabricated using a variety of materials, including, but not limited to ceramic, glass, organic polymers, polyethylene, polypropylene and/or any other convenient and or known materials that may be suitable for such a technique. The container (1) can be made to accommodate a lid/cover (not shown in the Figures).

Objects used to remove the edible and inedible contents of the container (1) may include chips, bread, crackers, or other food related items. In a non-limiting illustration, tortilla chips are examples of objects. Objects are not necessary to the container (1) system and they are merely illustrative examples of one of the many possible uses of the claimed system. For instance, in other embodiments, the objects may be spoons, forks, or any other commonly known utensils.

Figure 2:
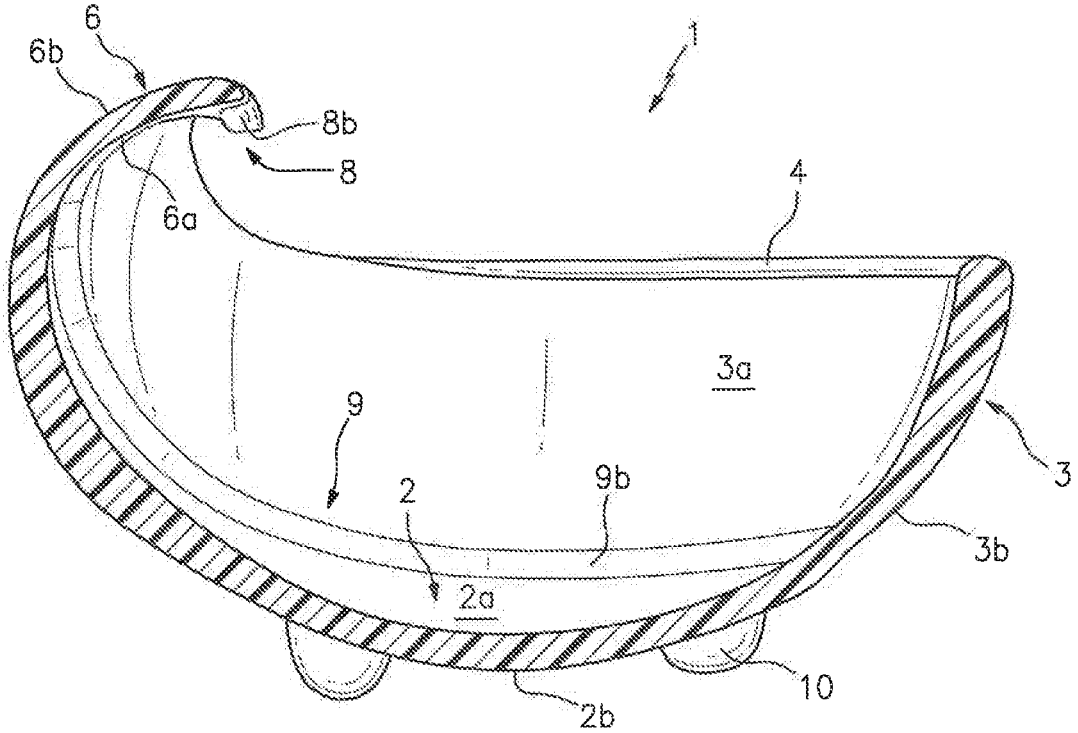
FIG. 2 presents a cut-a-way perspective side view of the claimed container system.

FIG. 2 depicts a side cut away interior view of the container (1). FIG. 2 includes base area (2), optional legs (10), wall (3), concave interior wall surface (3*a*), and convex exterior wall surface (3*b*). FIG. 2 further includes a perspective view of the channel (9), channel ridge (9*b*), and the rim (4) of the container (1), as well as projection (6), and concave interior and exterior projection wall surfaces (6*a*, 6*b*). Also presented in FIG. 2 is the apex (8) and projectile (8*b*), which can be round and smooth or somewhat pointed in shape, as more full described herein above.

An illustrative example of the container (1) utilizing tortilla chips paired with guacamole, salsa or dips. Utilizing the claimed container (1) and filling it halfway with guacamole dip, a user can take the tortilla chip and pass the chip through the dip towards the channel (9) pushing the chip and dip up the interior wall surface (6*a*) of the projection (6) to the apex (8) to obtained the desired amount of guacamole and exiting the container with out having spilled any of the guacamole outside the container (1). The claimed container system assists any person trying to stack adequate amounts of guacamole onto his or her chip because the channel (9), projection (6), apex (8), and its projectiles (8*a*, 8*b*) allow the user to apportion the desired amount of guacamole on chip instead of falling outside of the bowl or off of the chip.

Figure 3:
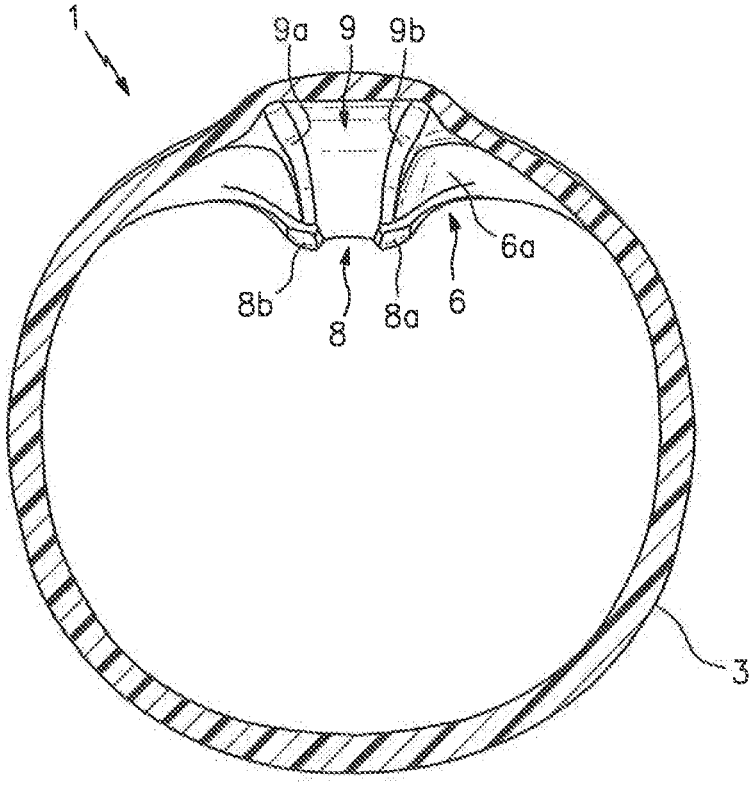
FIG. 3 presents an upward looking interior perspective view of the container having the bottom half of the container removed, so that the interior of the container's projection relative to the container is displayed.

FIG. 3 depicts an upward looking interior view looking through the container (1) having the base area (not shown) removed. The container's (1) wall (3), and in particular, the interior of the projection concave interior wall surface (6*a*), as well as the channel (9) and its ridges (9*a*, 9*b*) are visible in FIG. 3. In addition, the apex (8) and projectiles (8*a*, 8*b*) are clearly visible in FIG. 3. FIG. 3 illustrates the connection between the projectiles (8*a*, 8*b*) of the apex (8) and the ridges (9*a*, 9*b*) of the channel (9). The combination of the channel (9), the channel ridges (9*a*, 9*b*), the apex (8), and the projectiles (8*a*, 8*b*) provides an interface, whereby the contents of the container (1) can be appropriately apportioned by the user as they are removed.

According to another embodiment, an apportionment apparatus system (not shown in Figures) for use in conjunction with a serving medium, such as a bowl, a plate or a dish is disclosed herein. The apportionment apparatus system can be, for example, inserted into an existing bowl, or attached to a serving tray. The apparatus system can be proportionally sized for use with any size serving tray, dish, or bowl.

The system has a planar base that can be inserted into a serving medium. The planar base is not limited in size and can be, for example, for about 3 to 12 inches, and its width, for example, can be from 2 to 6 inches. The planar base's length and width are sized as needed to accommodate the serving medium to which it will be affixed or inserted. The planar base comprises a planar base top surface and a planar base bottom surface. The planar base top surface has edges that are contoured or sloped to meet the planar base bottom surface. The contoured edges facilitate the movement of the contents of the serving medium onto the planar base, if necessary.

Extending from one end of the planar base is a concave wall having concave interior wall surface and an exterior wall surface that may or may not be convex. The concave wall extends from the planar base at a suitable angle such that the angle forms an arc from the planar base to an apex that is at least about 70 degrees or more relative to the horizontal planar base. The concave wall is made to accompany conventional serving bowls as know in the art. The apex of the concave wall defines the end of the concave wall and contains at least two projectiles, as previously described herein. The concave wall dimensions are not limited, however, at the point where the concave wall extends away from and above the planar base its width may increase or decrease. Importantly, at about the angle of 45 degrees from the horizontally planar base top surface the concave wall tapers to form the apex. The concave wall's concave interior wall surface, as well as the planar base surface may be smooth or textured as desired.

As more fully discussed supra, a channel that may be defined by ridges is not limited in length, width, or height. The channel's ridges can be about 1 to about 3 mm or more in height. The channel can be a grove or indent without ridges in the planar base top surface. The channel extends the length of the planar base and along the concave interior wall surface of wall extending to the projectiles of the apex. The channel originates in approximately at the end of the planar base that is opposite the concave wall. The surface of the channel between the ridges is usually smooth, however, the surface may serrated, ribbed, or textured as desired.

The concave interior wall surface of the concave wall provides a degree of curvature (arc) as needed to facilitate the apportionment of the contents of the serving medium, and the exterior wall surface can be convex in nature or is essentially straight (i.e., without curvature). The thickness and width of the apparatus is not limited, and the planar base and concave wall may be configured to bend and flex to accommodate variously shaped edges or wall of serving mediums.

The apparatus system may have a fastener or clamp to secure the system to the serving medium. The fastener is not particularly limited and can be sized to accommodate holding the apportionment system to the serving medium as needed. For purposes of compactness an adjustable bracket fastener or the like as know in the art can be attached to the exterior wall surface to secure the apparatus system to a dish or serving plate. The fastener, e.g., a suction device, can be secured to the exterior wall surface and/or the planar base bottom surface and configured in size and diameter to fit the configuration of the edge of the serving medium, such as a dish or serving tray. The fastener, may be similar to a clamp that can be adjusted to accommodate various settings that configure to the edges of serving mediums. The system's fastener may include a fastener brace or stabilizing attachment that secures the use of the system when attached to the serving medium.

In other embodiments, individuals may only want to consume the edible substance by itself. In this case the object may be an eating utensil object. These objects include but are not limited to eating utensils like spoons, forks, and chopsticks.

In additional embodiments, individuals may want to easily push ample amounts of edible substances onto food preparation objects for cooking purposes. These food preparation objects include but are not limited to cooking utensils like spatulas, cooking spoons, scoops, ladles, and risotto paddles.

As used herein, the term "embodiment" means an embodiment that serves to illustrate by way of example but not limitation. It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A container comprising a base area having an interior base surface and an exterior base surface, a wall extending from the interior base surface, the wall having a concave interior wall surface extending from interior base surface and an exterior wall surface extending from the exterior base surface, a projection having a projection concave interior wall surface and a projection exterior wall surface that extends a portion of the wall beyond where the concave interior wall surface and the exterior wall surface combine to provide a substantially horizontal rim of the container, as the projection extends away from the base area of the container the projection concave interior wall surface arcs towards the base area and the center of the container to provide an arc of at least 70 degrees from the base area, wherein the width of the projection tapers from an initial width at a point where the projection extends a portion of the container wall to a width that provides an apex having at least two projectiles pointing towards the base area, a channel that extends from a point on the base area and along the concave interior wall surface and the projection concave interior wall surface to the projectiles; wherein the width of the channel is from about one-half centimeter to about ten centimeters on the interior base surface and narrows to about two to five centimeters at the projectiles.

2. The container of claim 1, wherein the container comprises at least one material from the group consisting of: polyethylene, polypropylene, titanium dioxide, mineral filler, polypropylene, ceramic, glass, tin, aluminum, steel, cast-iron, and wood.

3. The container of claim 1, further comprising a lid.

4. The container of claim 1, wherein the channel comprises ridges.

5. The container of claim 1, wherein the arc is at least 110 degrees.

6. The container of claim 1, wherein the arc is at least 130 degrees.

7. The container of claim 1, wherein the projection exterior wall surface is convex.

8. The container of claim 1, wherein the exterior wall surface extending from the exterior base surface is convex.

9. The container of claim 1, wherein the interior base area is substantially horizontal.

10. An apportionment apparatus is disclosed comprising a planar base having a planar base top surface and planar base bottom surface, a wall having a concave interior wall surface that extends from an end of the planar base top surface and an exterior wall surface that extends from the end of the planar base bottom surface, the concave interior wall surface extends away from the planar base and arcs towards the planar base to provide an arc of at least 70 degrees from the planar base, the width of the concave wall tapers from an initial width at the planar base to a width that provides an apex having at least two projectiles pointing towards the planar base, a channel that extends from an end of the planar base that is distal to the concave interior wall surface and along the planar base and the concave interior wall surface to the projectiles, and a fastener that is integral with the planar base bottom surface and/or the exterior wall surface; wherein the width of the channel is from one-half centimeter to ten centimeters on the planar base top surface and narrows to two to five centimeters at the projectiles.

11. The apportionment apparatus of claim 10, wherein the fastener is adjustable to accommodate an edge or a rim of a serving medium.

12. The apportionment apparatus of claim 10, wherein channel comprises ridges.

13. The apportionment apparatus of claim 10, wherein the exterior wall surface is convex.

14. The apportionment apparatus of claim 10, wherein the apparatus comprises at least one material from the group consisting of: polyethylene, polypropylene, titanium dioxide, mineral filler, polypropylene, ceramic, glass, tin, aluminum, steel, cast-iron, and wood.

15. The apportionment apparatus of claim 10, wherein the arc is at least 90 degrees or more.

16. The apportionment apparatus of claim 15, wherein the arc is at least 110 degrees or more.

17. The apportionment apparatus of claim 16, wherein the arc is at least 130 degrees or more.

18. The apportionment apparatus of claim 10, wherein the interior planar base top surface is substantially horizontal.

* * * * *